US007973733B2

(12) United States Patent
Mohammadian

(10) Patent No.: US 7,973,733 B2
(45) Date of Patent: Jul. 5, 2011

(54) ELECTROMAGNETICALLY COUPLED END-FED ELLIPTICAL DIPOLE FOR ULTRA-WIDE BAND SYSTEMS

(75) Inventor: Alireza Hormoz Mohammadian, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 993 days.

(21) Appl. No.: 10/769,419

(22) Filed: Jan. 30, 2004

(65) Prior Publication Data

US 2004/0217912 A1 Nov. 4, 2004

Related U.S. Application Data

(60) Provisional application No. 60/465,662, filed on Apr. 25, 2003.

(51) Int. Cl.
*H01Q 9/16* (2006.01)

(52) U.S. Cl. ..... 343/793; 343/700 MS

(58) Field of Classification Search ..... 343/795, 343/829, 846
See application file for complete search history.

(56) References Cited

U.S. PATENT DOCUMENTS

| | | | | |
|---|---|---|---|---|
| 3,836,976 | A * | 9/1974 | Monser et al. | 343/795 |
| 3,887,925 | A | 6/1975 | Ranghelli et al. | |
| 3,947,850 | A * | 3/1976 | Kaloi | 343/795 |
| 4,083,046 | A | 4/1978 | Kaloi | |
| 4,287,518 | A | 9/1981 | Ellis, Jr. | |
| 4,816,836 | A * | 3/1989 | Lalezari | 343/700 MS |
| 4,843,403 | A * | 6/1989 | Lalezari et al. | 343/767 |
| 4,980,693 | A * | 12/1990 | Wong et al. | 343/700 MS |
| 5,005,019 | A * | 4/1991 | Zaghloul et al. | 343/700 MS |
| 5,287,116 | A * | 2/1994 | Iwasaki et al. | 343/700 MS |
| 5,319,377 | A | 6/1994 | Thomas et al. | |
| 5,598,174 | A | 1/1997 | Erkocevic et al. | |
| 5,754,145 | A | 5/1998 | Evans | |
| 5,872,546 | A | 2/1999 | Ihara et al. | |
| 5,898,405 | A | 4/1999 | Iwasaki | |
| 5,949,383 | A | 9/1999 | Hayes et al. | |
| 6,037,911 | A | 3/2000 | Brankovic et al. | |
| 6,091,373 | A * | 7/2000 | Raguenet | 343/778 |
| 6,094,179 | A | 7/2000 | Davidson | |
| 6,191,740 | B1 * | 2/2001 | Kates et al. | 343/700 MS |
| 6,222,494 | B1 | 4/2001 | Erkocevic | |

(Continued)

FOREIGN PATENT DOCUMENTS

EP 0301216 2/1989

(Continued)

OTHER PUBLICATIONS

Nilavalan et al., "Wideband Printed Bow Tie Antenna Element Development for Post Reception Synthetic Focusing Surface Penetrating Radar," Electronics Letters, IEE Stevenage vol. 35, No. 20, Sep. 30, 1999, pp. 1771-1772.

(Continued)

*Primary Examiner* — Trinh V Dinh
(74) *Attorney, Agent, or Firm* — Jonathan T. Velasco

(57) ABSTRACT

An antenna that includes a first plane, a second plane spaced apart from the first plane, a first radiating surface, positioned substantially on the first plane, to act as a poise, a second radiating surface to act as a counterpoise, and an end-feed microstrip positioned on the second plane, wherein the first radiating surface and the second radiating surface are electromagnetically coupled to the end-feed microstrip.

18 Claims, 9 Drawing Sheets

U.S. PATENT DOCUMENTS

| | | | | |
|---|---|---|---|---|
| 6,337,666 | B1 | 1/2002 | Bishop | |
| 6,339,405 | B1 * | 1/2002 | Gleener | 343/795 |
| 6,400,332 | B1 * | 6/2002 | Tsai et al. | 343/795 |
| 6,512,488 | B2 | 1/2003 | Schantz | |
| 6,559,809 | B1 * | 5/2003 | Mohammadian et al. | 343/795 |
| 6,642,903 | B2 | 11/2003 | Schantz | |
| 6,768,461 | B2 | 7/2004 | Huebner et al. | |
| 6,774,850 | B2 * | 8/2004 | Chen | 343/700 MS |
| 7,123,207 | B2 * | 10/2006 | Yazdandoost et al. | 343/795 |
| 7,158,089 | B2 * | 1/2007 | Mohammadian et al. | 343/795 |
| 7,183,977 | B2 | 2/2007 | Suh | |
| 7,209,089 | B2 * | 4/2007 | Schantz | 343/787 |
| 7,589,676 | B2 * | 9/2009 | Popugaev et al. | 343/700 MS |
| 2003/0201942 | A1 * | 10/2003 | Poilasne et al. | 343/702 |
| 2004/0036655 | A1 * | 2/2004 | Sainati et al. | 343/702 |
| 2004/0100406 | A1 | 5/2004 | Okado | |
| 2004/0217903 | A1 * | 11/2004 | Aisenbrey | 343/700 R |
| 2005/0110687 | A1 | 5/2005 | Starkie et al. | |
| 2005/0233786 | A1 * | 10/2005 | Hatch | 455/575.7 |
| 2005/0259013 | A1 * | 11/2005 | Gala Gala et al. | 343/702 |

FOREIGN PATENT DOCUMENTS

| | | |
|---|---|---|
| EP | 0766343 | 4/1997 |
| GB | 2359664 | 8/2001 |
| WO | 97/41695 | 11/1997 |

OTHER PUBLICATIONS

International Search Report and Written Opinion—PCT/US2004/012578, International Search Authority—European Patent Office—Aug. 18, 2004.

* cited by examiner

ELECTROMAGNETICALLY COUPLED END-FED ELLIPTICAL DIPOLE FOR ULTRA-WIDE BAND SYSTEMS

CLAIM OF PRIORITY UNDER 35 U.S.C. §119

The present Application for Patent claims priority to Provisional Application No. 60/465,662 entitled "END-FED ELLIPTICAL DIPOLE FOR ULTRA-WIDE BAND SYSTEMS" filed Apr. 25, 2003, and assigned to the assignee hereof.

BACKGROUND

1. Field

The present invention relates generally to electromagnetic radiation and reception, and more specifically to ultra wide band antennas for wireless communications.

2. Background

Ultra Wideband (UWB) radio is a wireless technology for transmitting digital data over a wide spectrum of frequency bands with very low power. It can transmit data at very high rates (for wireless local area network applications). Within certain power limits allowed, Ultra Wideband can not only carry huge amounts of data over a short distance at very low power, but also has the ability to carry signals through doors and other obstacles that tend to reflect signals at more limited bandwidths and a higher power. At higher power levels, UWB signals can travel to significantly greater ranges. Instead of traditional sine waves, ultra wideband radio broadcasts digital pulses that are timed very precisely on a signal across a very wide spectrum at the same time. Transmitter and receiver must be coordinated to send and receive pulses with an accuracy of trillionths of a second. Ultra wideband can also be used for very high-resolution radars and precision (sub-centimeter) radio location systems.

Since UWB systems may consume very little power, around one ten-thousandth of that of cell phones, this makes UWB practical for use in smaller devices, such as cell phones and PDAs that users carry at all times. With UWB operating at such low power, it may have very little interference impact on other systems. UWB may cause less interference than conventional radio-network solutions. In addition, the relatively wide spectrum that UWB utilizes can significantly minimize the impact of interference from other systems as well.

A UWB antenna must have a very wide bandwidth such as in the frequency range of approximately 3 GHz to 10 GHz that is nearly omni-directional in the horizon, small in size with low physical profile and that is inexpensive to manufacture and to embed, if necessary, in a wireless communication device.

An antenna that can be considered for use as an UWB antenna is a half-wave antenna, referred to as a dipole, or doublet, which consists of two lengths of wire rod, or tubing, each ¼ wavelength long at a certain frequency. It is the basic unit from which many complex antennas are constructed. The half-wave antenna operates independently of ground; therefore, it may be installed above the surface of the Earth or other absorbing bodies.

SUMMARY

In one embodiment, an antenna is described that can be a dipole whose poise and counterpoise are two radiators that each can be at least partially elliptical in shape. This antenna can be fed a signal by an end-fed micro strip line that utilizes a portion of the counterpoise as its ground plane. In a variation, two slots can be introduced into the counterpoise that effectively converts the counterpoise into a choke to create a nearly-balanced feed and antenna.

In another embodiment, a poise portion of the antenna can be non-planar in that a portion of the surface can have one or more bends to reduce the overall length to improve packaging constraints.

BRIEF DESCRIPTION OF THE DRAWINGS

FIG. 4C is an illustration of an end view of the embodiment; and

DETAILED DESCRIPTION

Figure 1A:
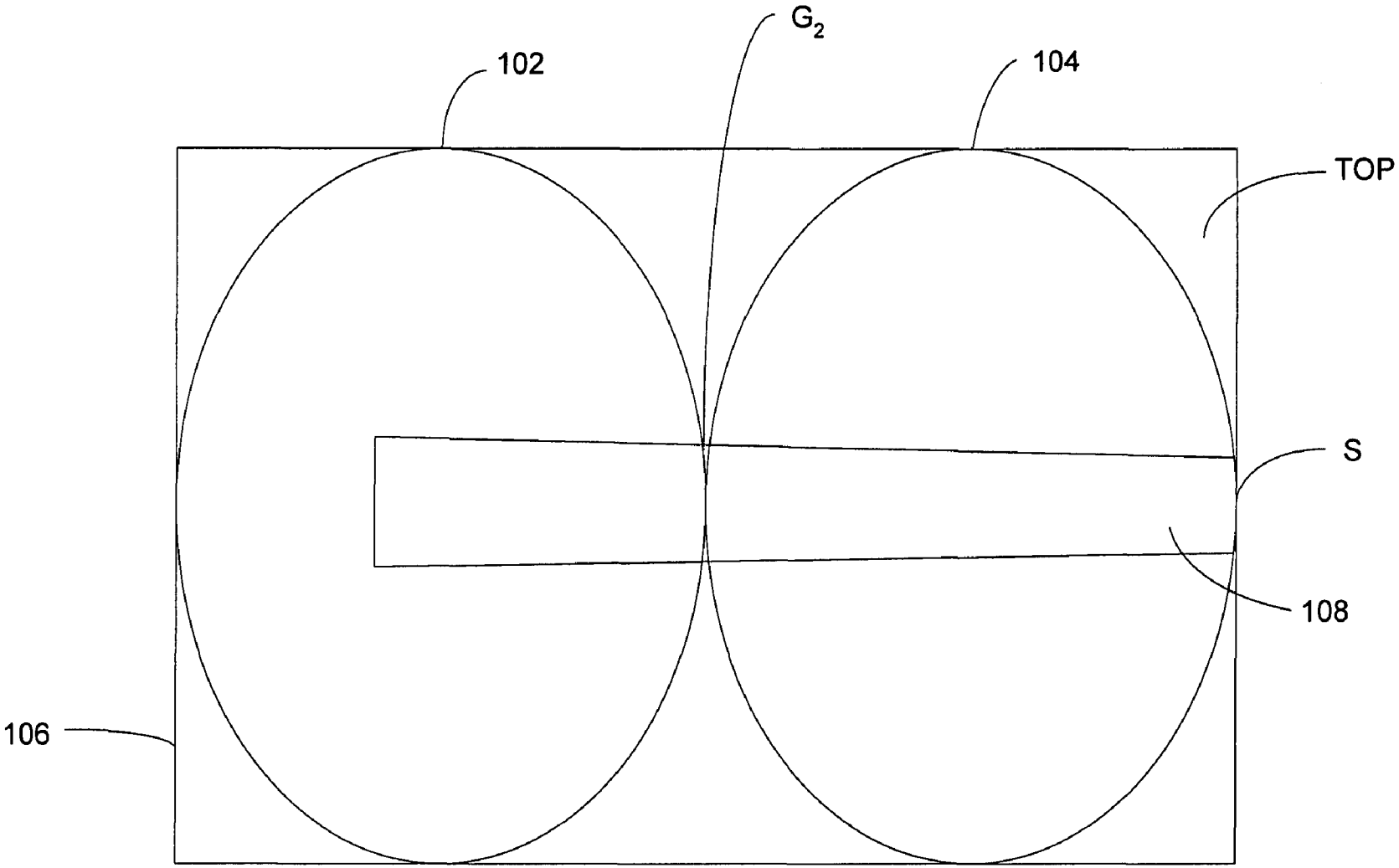
FIG. 1A is an illustration of a top view of one embodiment of an electromagnetically coupled elliptical planar dipole antenna.

A dipole antenna is disclosed for use in an UWB system that can be capable of a bandwidth in the frequency range of approximately 3.1-10.6 GHz. This ultra wide band dipole antenna can have full or partial elliptically shaped radiative surfaces, where the radiative surfaces can be one or any combination of curved, planar, partially planar and partially curved, or planar with one or more bends. The dipole antenna can radiate a nearly omni-directional pattern in the horizon, can be small in size with a low physical profile, and inexpensive to manufacture and to embed such as into a wireless communication handset or a modem. The antenna disclosed can obtain a desired bandwidth by sizing the length of the radiating surfaces of the antenna. The antenna performance can be set by sizing the radiative areas of the antenna. For example, for a determined length, by controlling the width, such as, for example, the major axes of the ellipses, a desired total radiative area can be provided.

The UWB antenna disclosed can have matched impedance, such as, for example, a 10 dB match so that the antenna can resonate at the required frequencies. The antenna can be fed a signal supplied by a micro-strip feed that may use the counterpoise as its ground plane, and thereby form an end-fed dipole with the advantage of having a more compact size for various applications including integration into a compact handset. The end-fed strip can be electromagnetically coupled to the radiative surfaces. The length of the microstrip feed can be an additional parameter, besides its width, to improve the antenna match. The counterpoise can have slots that can carve out a ground plane for the microstrip feed with the advantage of a more balanced antenna. This can result in the reduction of common-mode current on the microstrip feed line, thereby preventing distortion in the radiation pattern often caused by a common-mode current on the antenna feed line, as well as reducing antenna input impedance variation caused by a change in the RF board. Also, a reduction of the stray common-mode current on the microstrip feed and its ground plane can create a nearly balanced antenna.

Many uses will be available for UWB wireless data communications devices, such as, for example:

- Automotive collision-detection systems and suspension systems that respond to road conditions.
- Medical imaging, similar to X-ray and CAT scans.
- Through-wall imaging for detecting people or objects in law-enforcement or rescue applications.
- Construction applications, including through-wall imaging systems and ground-penetrating radar.
- Communications devices, such as high-speed home or office networking or wireless cell phone, both military and consumer, communications A PDA, a computer peripheral device, a collision-detection system, a suspension system, through-wall imaging systems and a ground-penetrating radar.

Because UWB has the ability to penetrate walls and transmit data at rates up to 1 gigabit per second, UWB could have the ability to become the center of all communications within a single location, such as a home or small office environment. That means the same devices could contain the data to support high-speed Internet traffic, streaming video and phone.

Beyond the distribution of wireless audio, video and data over local area networks for home and office, UWB has the unique ability to resolve Geo-Positional location to centimeter accuracy as a by-product of sending and receiving data between multiple UWB devices. Think of wireless Internet and video capable devices such as smart phones, PDA's, laptop computers, web-pads, digital video cameras, automobiles and a wide range of consumer electronics and home appliances with extremely precise, GPS-like positioning.

In one embodiment, a dipole antenna can be fed a signal by a conductive microstrip that may use the counterpoise as its ground plane, thereby making an end-fed dipole with the advantage of contributing to a more compact size for various applications such as, for example, those mentioned above. Another advantage associated with the end feeding approach is to not shadow the pattern like the conventional center-fed dipoles. Further, this antenna can have a more omni-directional pattern than most other antennas capable of generating ultra wide band frequencies.

In one embodiment, the dipole antenna can be electromagnetically fed. An antenna is defined as electromagnetically fed, or a feed line for an antenna can be said to be electromagnetically coupled, to the antenna when the feed line (microstrip, coaxial cable, etc.) does not have a physical metallic contact to the antenna (i.e. the radiating surfaces of the antenna) but rather maintains a small gap, in free space or in a dielectric medium, with the antenna. The electromagnetic (EM) energy in case of a metallic contact may be said to flow to the antenna via an electric current from the feed line to the antenna. For an electromagnetic coupling, since there is no physical metallic contact between the antenna and the feed line, the near field EM energy may be said to flow through the medium to the antenna. It may also be said that the electric current on the feed line, when reached at the gap, is converted to what is know as the "displacement" current which flows through the free space or dielectric medium to reach the antenna.

The elliptically shaped conductive surfaces can be made on a large scale, such as, for example, out of sheet metal. For the small or micro-scale, the dipoles can be deposited on a printed circuit board (PCB) or a microchip. Such manufacturing methods for the small or micro-sized antenna can include photoresist techniques used in constructing printed circuit boards and microchips, i.e. masking, patterning and etching.

Figure 1B:
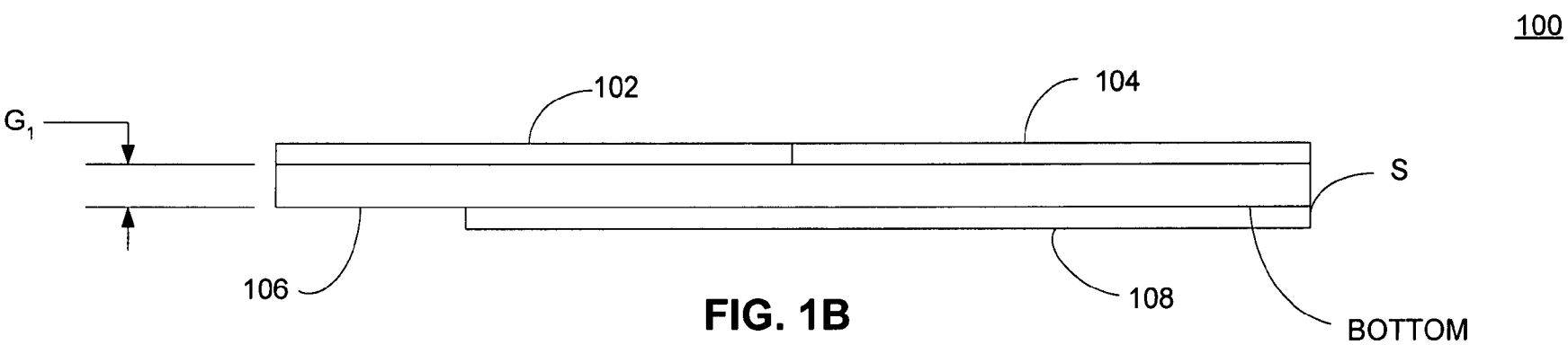
FIG. 1B is an illustration of a side view of the embodiment.

FIG. 1A is an illustration of a top view of one embodiment of an elliptical planar dipole antenna having an electromagnetically coupled end-feed. FIG. 1B is an illustration of a side view illustration of the embodiment of the dipole antenna. In both figures, thicknesses and other relationship of size may not be shown to scale. On a first plane, the antenna 100 can have two planar conducting elliptical surfaces 102, 104 positioned. A first ellipse 102, i.e. the poise, and a second ellipse 104, i.e. the counterpoise, can be positioned on the first plane that is a top surface of a dielectric 106 such as a fiberglass substrate. The poise102 and counter poise 104 can be capable of electromagnetic radiation. The antenna, containing the poise 102 and the counterpoise 104 can have a small gap G2 between the two ellipses, can be fed electromagnetically at this gap by a micro-strip line 108 that can come in at an edge of the substrate 106 ant one end of the antenna 100, i.e. the antenna is end-fed. The microstrip line 108 can be positioned on a second plane that can be a bottom surface of the dielectric 106. The microstrip line 108 can have a varying width to have a better match of the antenna impedance to the source generator (transmitter), such as, for example, narrower at the edge of the substrate 106 and wider at the other end (as shown) or the microstrip line 108 can be wider at the edge of the substrate 106 and narrower at the other end (not shown).

A radio-frequency (RF) signal can be applied at an end of the feed line 108 at S with the feed line maintaining a gap $G_1$ between the end-feed line 108, the counterpoise 104, and where the feed line 108 may extend, at least partially, along the poise surface 102. RF suitable connections such as attachments for coaxial cable leads or spring leads (not shown) may be provided on antenna 100 for such purposes.

A voltage at the gap $G_2$ between the poise 102 and the counterpoise 104 can be created by the RF signal, to cause an RF current to flow on the poise 102 and the counterpoise 104. The differential current $I_d$ carried by the feed line 108 can return to the source, i.e. to point S, along the surface of the ground plane 104 that is closest the feed line 108.

Figure 2A:
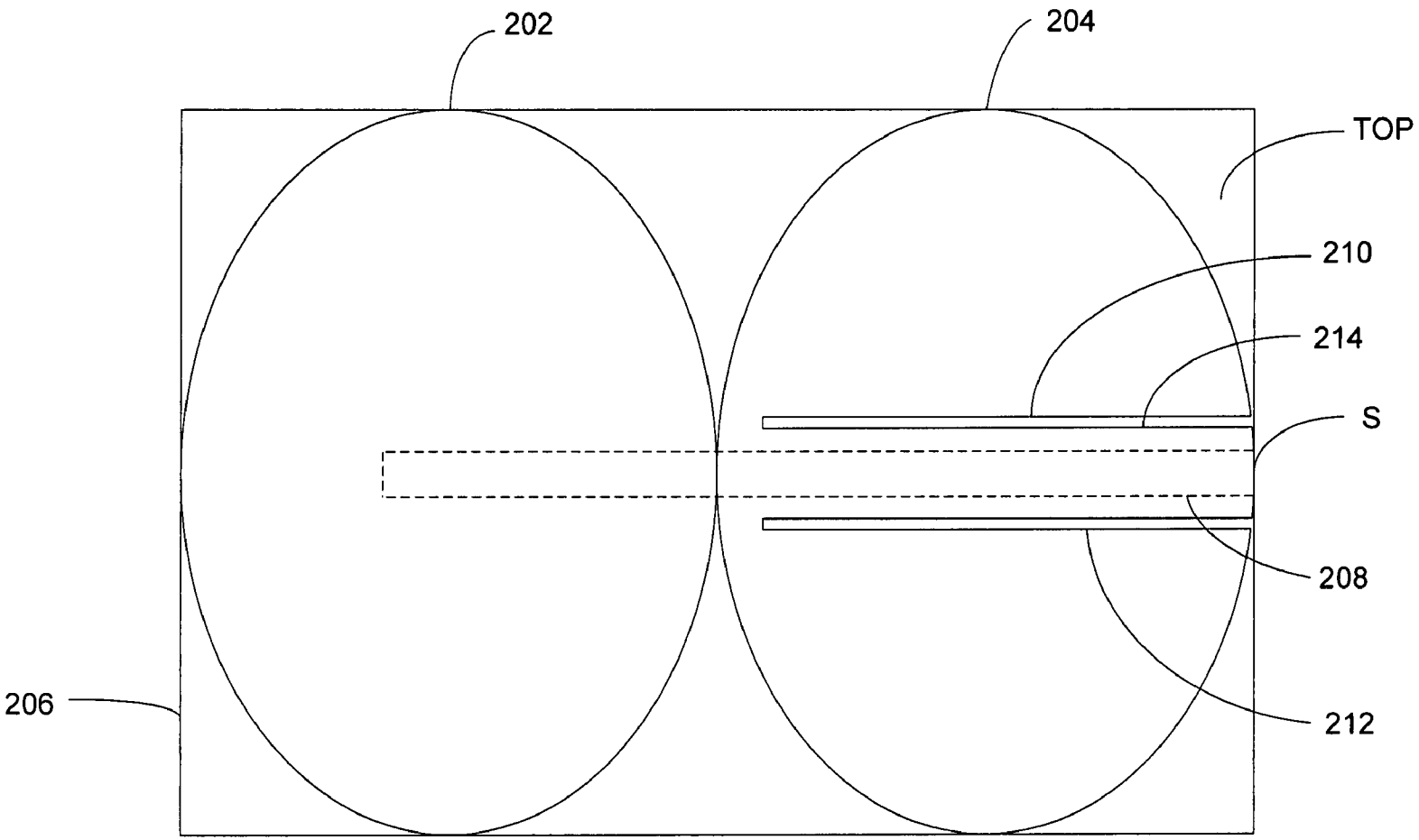
FIG. 2A is an illustration of a top view of an alternate embodiment, where the counterpoise can be slotted.
Figure 2B:
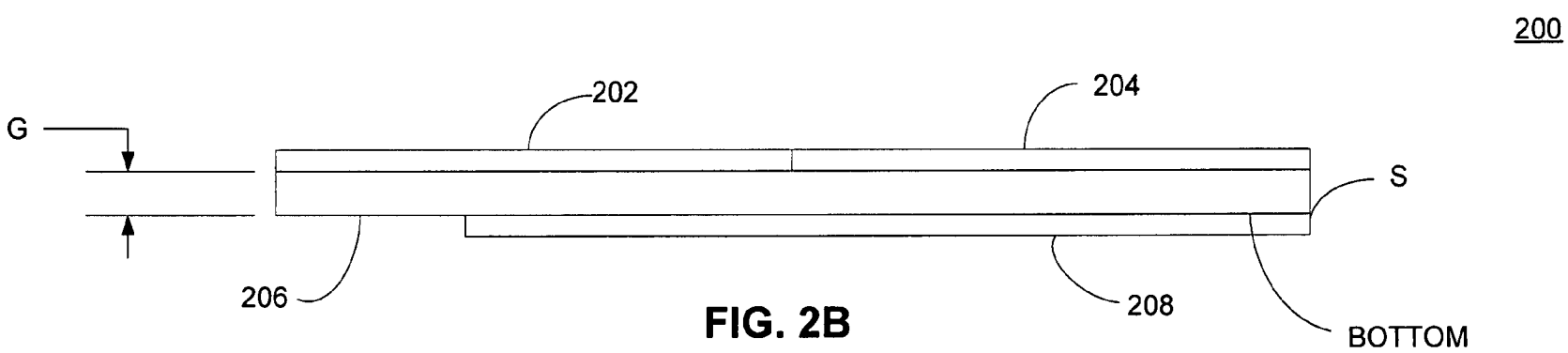
FIG. 2B is an illustration of a side view of the alternate embodiment.

Shown in FIGS. 2A & 2B, are an alternate embodiment, where the counterpoise can be trifurcated and where thicknesses and other relationships of size are not shown to scale. FIG. 2A is an illustration of a top view and FIG. 2B is an illustration of a side view of the embodiment. This antenna 200 can have two planar conducting elliptical surfaces 202, 204 on a first plane. A first ellipse 202, i.e. the poise, and a second ellipse 204, i.e. the counterpoise, can be positioned on the first plane that is a top surface of a dielectric 206 such as a fiberglass or silicon substrate. The poise 202 and the counterpoise 204 can be capable of electromagnetic radiation. The antenna 200 made up of the poise 202 and the counterpoise 204 with a small gap between the two ellipses can be fed electromagnetically at this gap by a micro-strip 208 line that can come in at an edge of the substrate 206, at one end of the antenna 200, i.e. the antenna 200 can be end-fed. The microstrip line 208 can be positioned on a second plane that is a bottom surface of the substrate 206. The photoresist/etch process depositing the radiating surfaces can form slots 210 and 212 in the counterpoise surface 204 to effectively form a choke between the ground plane 214 and the counterpoise 204 that can create an approximately balanced feed and antenna.

Figure 3A:
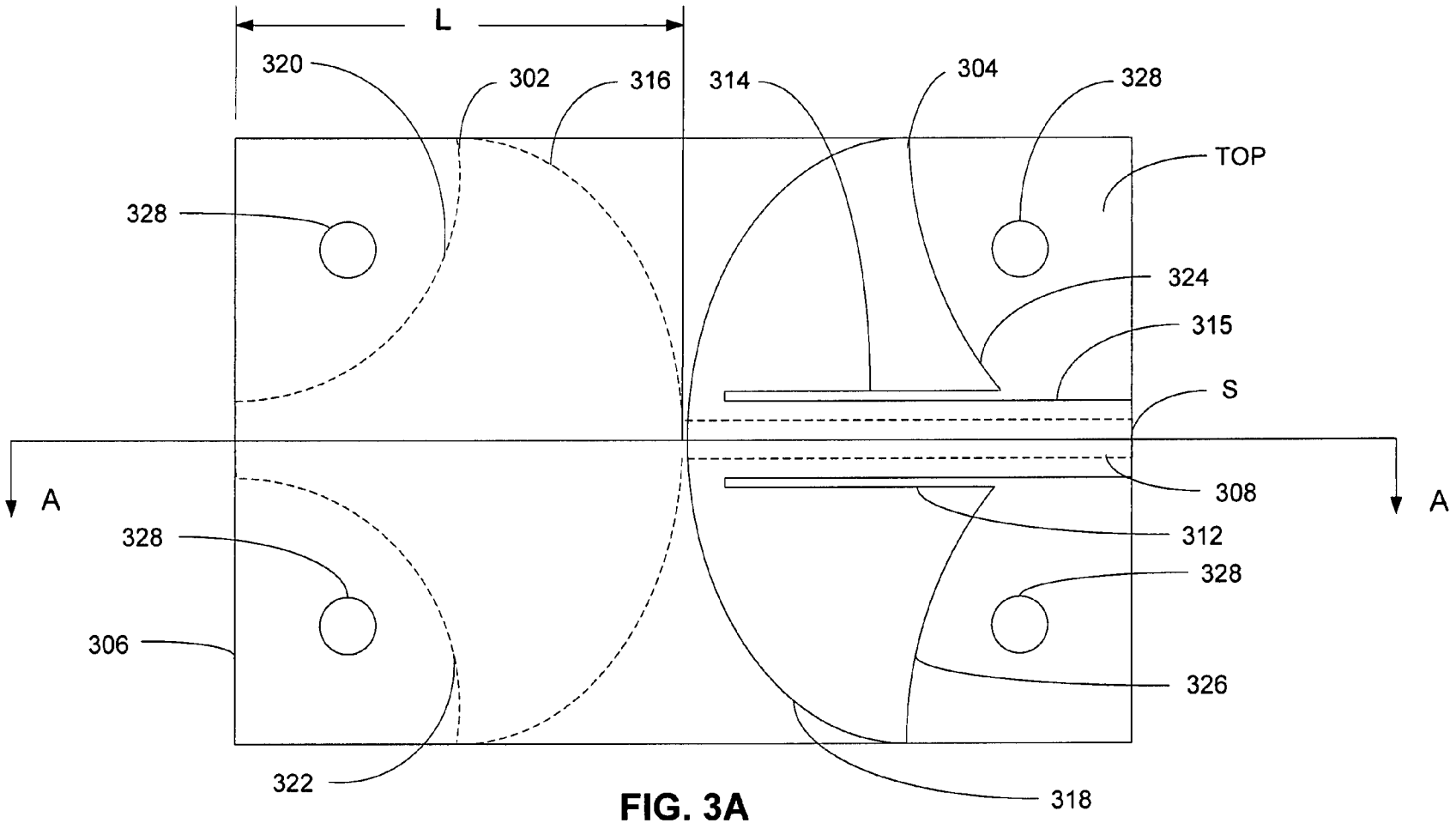
FIG. 3A is an illustration of a top view of another embodiment where the poise and counterpoise can have partial ellipse shapes.
Figure 3B:
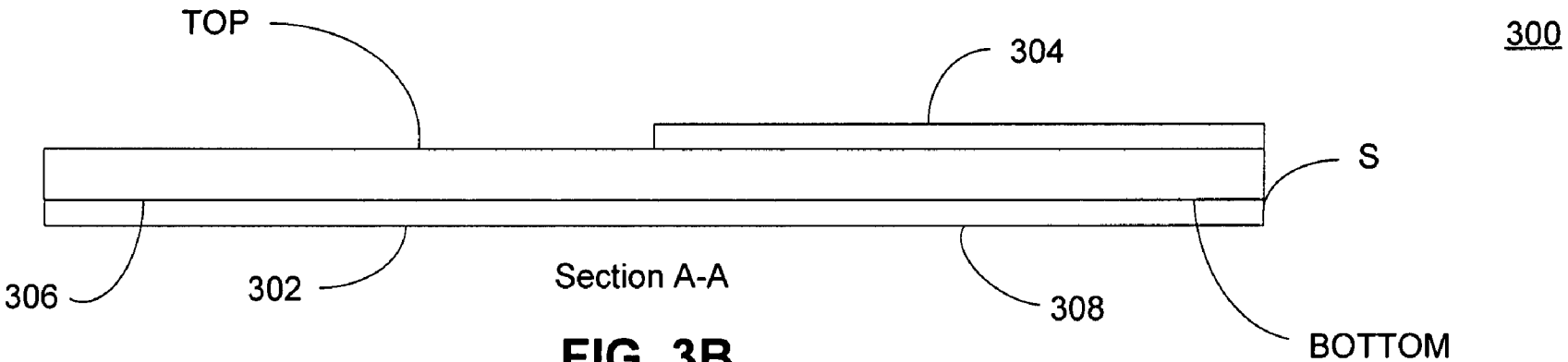
FIG. 3B is an illustration of a side view of this embodiment.

Shown in FIGS. 3A & 3B is another embodiment, where the poise and counterpoise can have partial ellipse shapes and where thicknesses and other relationships of size are not shown to scale. FIG. 3A is a top view illustration of this embodiment and FIG. 3B is Section A-A that illustrates a cross-section view. The antenna 300 can have two planar, partially elliptical, electrically conductive surfaces 302, 304. A first ellipse 302, can be positioned on a second plane and shown in dashed line in the FIG. 3A top view. The first ellipse 302 can act as a poise, a radiating surface that can be positioned on a bottom surface of a dielectric 306 such as, for example, a fiberglass or silicon substrate. A second ellipse 304 can be positioned on a first plane to act as a counterpoise surface and where the first plane can be a top surface of the dielectric 306. The poise 302 and the counterpoise 304 can be capable of electromagnetic radiation. The poise 302 can be connected to a microstrip line (dashed line), i.e. the end-feed 308, also on the bottom surface and which can start at a location S at the edge of the substrate 306 and where a signal can be applied at this location S.

The photoresist/etch process that deposits the conductive surfaces 302 and 304 can form slots 312 and 314 in the counterpoise surface 304 to effectively form a choke between the ground plane 315 and the counterpoise 304 that can create an approximately balanced feed and antenna. The photoresist/etch process can also shape the poise 302 and counterpoise 304 conductive surfaces into shapes that are partial ellipses. Adjacent edges of the poise 302 and counterpoise 304 that separate uniformly for a distance, such as, for example, as shown here with elliptical edges 316 and 318, are crucial to the functioning of the dipole antenna 300. However, only these adjacent edges 314 and 316 of the conducting surfaces 302 and 304 require this relationship. After a distance is reached between these adjacent surfaces 314 and 316, a variety of different shape, such as, for example, the cutouts 320, 322, 324 and 326 as shown, can be tolerated. The advantage of partial ellipse shapes 316, 320, 322 and 314, 324 and 326 is that the real estate, i.e. the shape of the radiators 302 and 304 can be tailored to work around other internal components and/or features that may exist in a device (not shown) that may be competing for the space such as, for example, holes for fasteners (i.e. bolts or clips). As shown in FIG. 3A, ellipses 316 and 318 have cutouts 320 and 322, and 324 and 326, respectively, where conductive material has been removed (or not deposited) while maintaining total conductive area and a length L at necessary dimensions to meet performance requirements. In these cutout areas 320, 322, 324 and 326, as an example, features such as, for example, clearance holes 328 for fasteners (not shown) can be placed.

It should be appreciated that the dipole antenna represented in FIGS. 3A & B, and described above, can have the poise 302 and counterpoise 304 positioned on the same dielectric 306 surface (i.e. top or bottom) and have the end-fed microstrip 308 positioned on the opposite surface and the poise 302 can be electromagnetically coupled to the end-feed 308 as illustrated in FIGS. 2A & 2B and also described above.

Figure 4A:
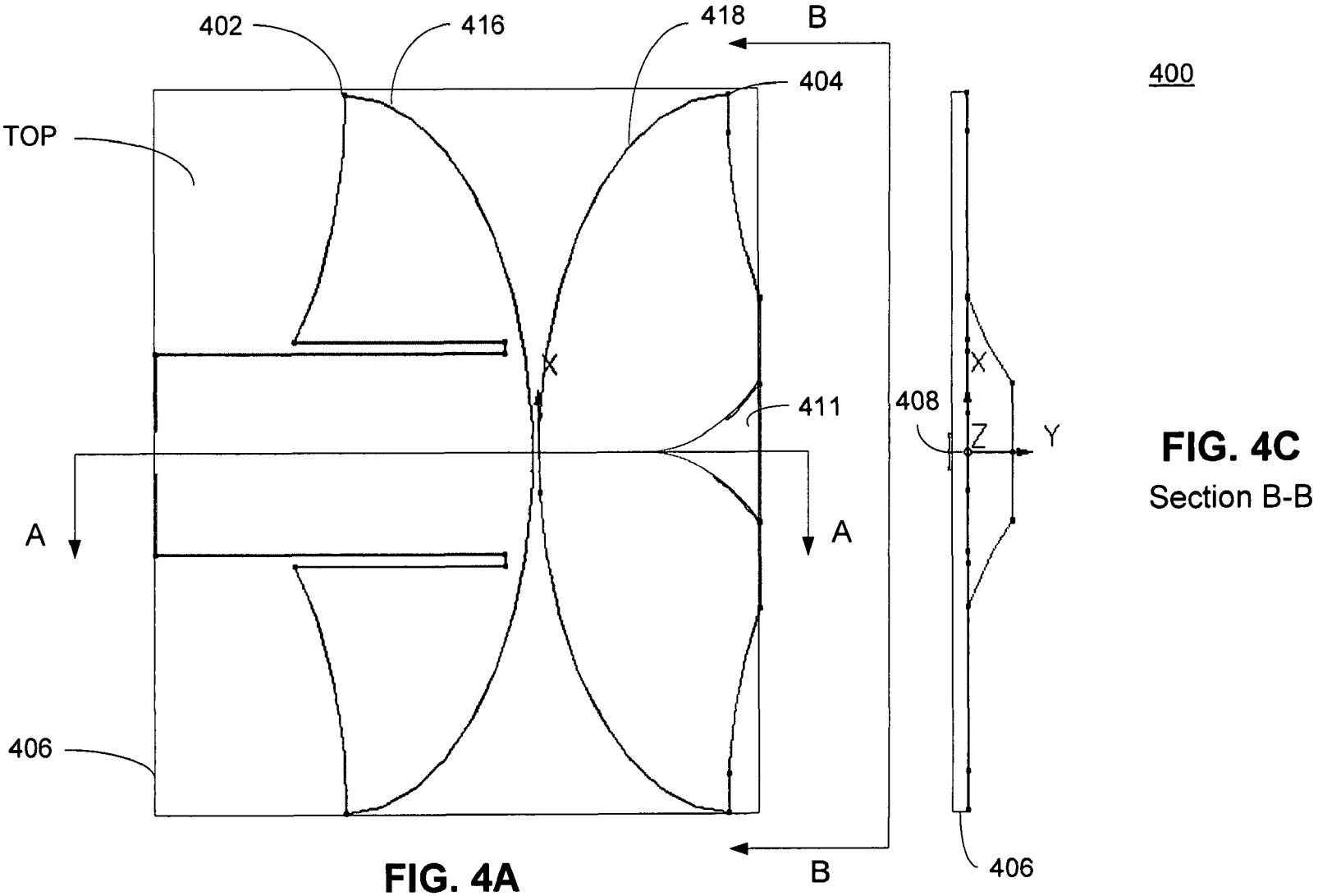
FIG. 4A is an illustration of a top view of another embodiment of a dipole antenna where bends can be placed in the poise conductive surface.
Figure 4B:
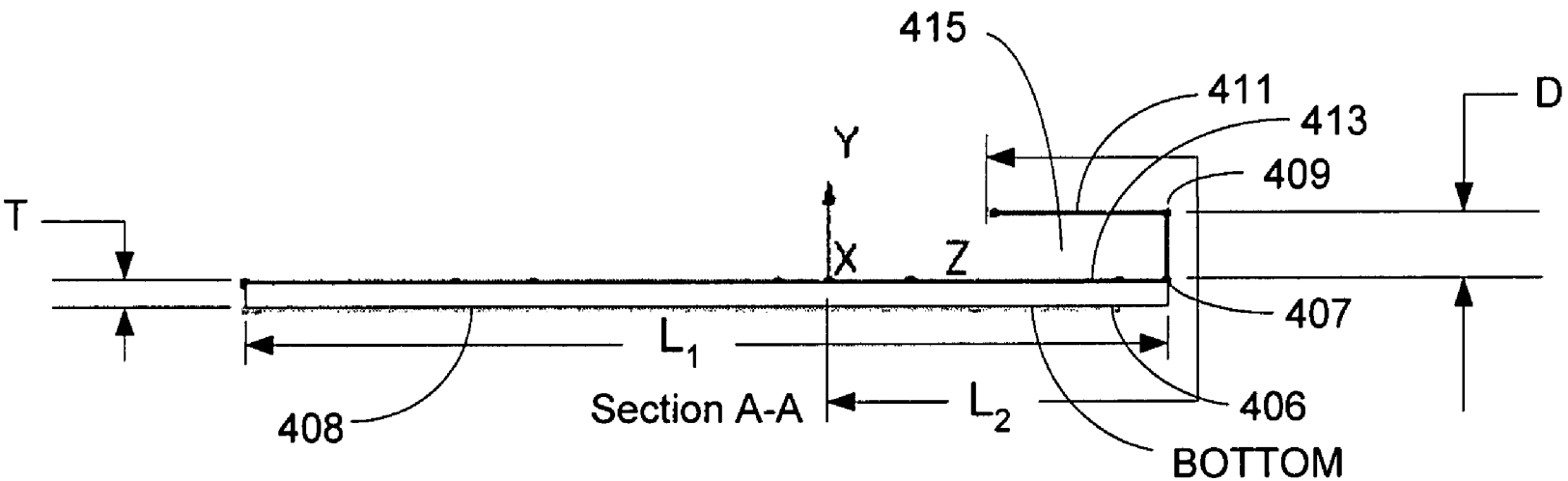
FIG. 4B is an illustration of a side view of the embodiment.
Figure 4D:
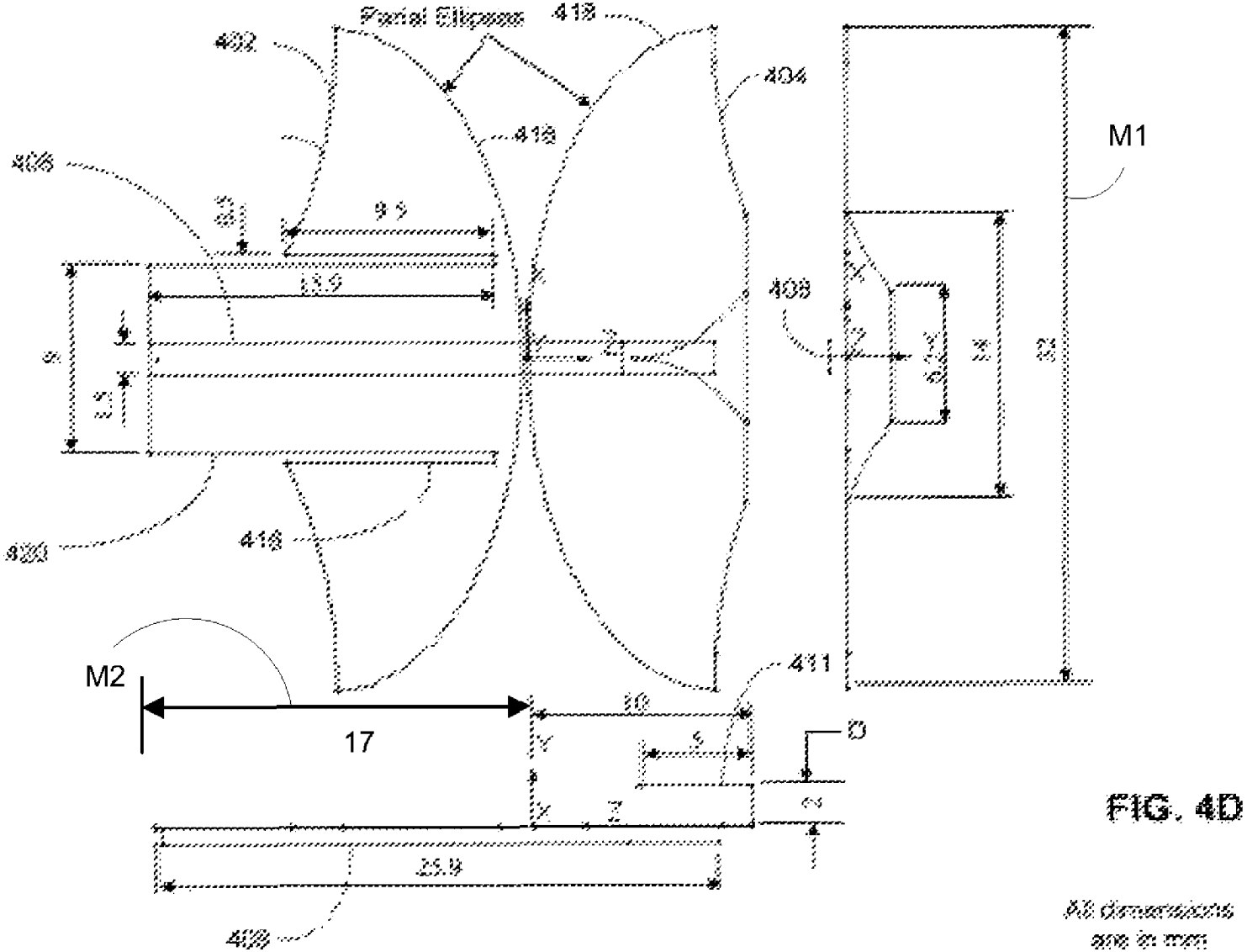
FIG. 4D is an illustration of the embodiment with dimensions added.

FIGS. 4A, 4B, 4C & 4D are illustrations of yet another embodiment of the invention, where bends can be placed in the poise conductive surface. FIG. 4A is a top view illustration, FIG. 4B is Section A-A that illustrates a cross-section view, FIG. 4C represents an end view and FIG. 4D illustrates some dimensions for the embodiment.

In this embodiment, a dipole antenna 400 can have poise 402 and counterpoise 404 conducting surfaces and where the adjacent edges 416 and 418 of these surfaces 402 and 404 can be partial ellipses. The poise 402 can be substantially positioned on a first plane and the counterpoise 404 can be completely positioned on the first plane, such as, for example, a top surface of a dielectric 406. An electromagnetically coupled microstrip feed 408 can be positioned on a second plane, such as a bottom surface of the dielectric 406. The microstrip feed 408 may be separated from the poise 404 and counterpoise 402 by a distance T that can be, for example, the thickness of the dielectric material 406. Although substantially positioned on the top surface, the poise 404 can have two bends 407 and 409 that lift a tip 411 of the poise 404 off the top surface and effectively fold a portion of the poise 404 back on itself. One or more bends may be used to affect a fold in the poise 404. A result of folding, i.e. bending the poise 404 is to reduce the overall length $L_1$ of the dipole antenna 400 while maintaining the critical poise length $L_2$. Minimizing the overall dipole antenna 400 length $L_1$ can improve packaging the dipole antenna 400 into a structure such as a computer mouse, a printer, a PDA or a cell phone housing (none shown). In one embodiment, the folded poise end 411 can be separated from the primary poise surface 413 by a distance D. Depending on manufacturing considerations, the space 415 between the poise end 411 and the primary poise surface 413 can be filled with, such as, for example, air or a dielectric (not shown). Within limitations, having the poise 418 in a bent condition may not severely impair the effectiveness of transmission, especially if the value of D is not less than 2 mm for the given frequency range.

FIG. 4D is an illustration of approximate dimensions of the one embodiment of the dipole antenna that uses a substrate material commercially known as FR4. In FIG. 4D, the dielectric material (shown as 408 in FIGS. 4A-4C) has been removed for clarity. The bent dipole antenna 400 can have poise 402 and counterpoise 404 adjacent ellipses 416 and 418 with major axes M1 of approximately 32 millimeters (mm) and minor axes M2 of approximately 17 mm. The planar length of the poise can be approximately 10 mm, the length of the folded back poise 411 can be approximately 5 mm and the length of the microstrip fee 408 can be approximately 25.9 mm. The microstrip feed 408 can be 1.5 mm wide and 25.9 mm long and where each slot 416 separating the 9 mm wide ground plane 420 from the counterpoise 402 can be approximately 0.5 mm wide by 9.5 mm long.

The elliptical dimensions of the antenna 400, i.e. of the first and second radiating surfaces, can have a ratio of a major axis to a minor axis in the range of approximately 1.00:1 to 1.90:1 with approximately 1.50:1 being optimal for most cases. In regular dipoles the length of the poise and counterpoise are normally a quarter of a wavelength (or 0.25 the wavelength). In this elliptical dipole, the minor axis can be approximately equivalent to (or plays the role of) the length of the poise or counterpoise in a regular dipole. Since the elliptical dipole may be considered a very fat dipole, the fatness, i.e. the major axis, can make up, to a degree, for the length and instead of 0.25 wavelength, only a 0.2 wavelength approximate may be necessary. However, keep in mind that a narrow dipole is a very resonant structure meaning that it can function as a good radiator at the frequency whose wavelength is used as a yard stick to measure that 0.25 length. In the UWB antenna, the wavelength used in measuring the minor axis (that is the 0.2 wavelength) is for the lowest frequency of this antenna, that is 3.1 GHz. That is why the minor axis is greater than or equal to 0.2 wavelength for it is "=" at 3.1 GHz and ">" at frequencies higher than that.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, and shapes described in connection with the embodiments disclosed herein may be implemented as electronic hardware, computer software, or combinations of both. Whether any functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various types of signal inputs into the antenna, described in connection with the embodiments disclosed herein, may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A dipole antenna comprising:

a first plane;

a second plane spaced apart from the first plane;

a first radiating surface, positioned on the first plane, to act as a poise;

a second radiating surface is positioned on the first plane to act as a counterpoise;

at least two slots formed in the second radiating surface which effectively form a choke between the counterpoise and a ground plane; and an end-feed microstrip positioned on the second plane, wherein the first radiating surface and the second radiating surface are electromagnetically coupled to the end-feed microstrip to form said dipole antenna, and wherein the end-feed microstrip is configured to match an impendence of the first radiating surface and the second radiating surface based on both a length of the end-feed microstrip and a width of the end-feed microstrip such that a first end of the end-feed microstrip is wider than a second end.

2. The antenna of claim 1, further comprising cutouts in the counterpoise.

3. The antenna of claim 1, wherein adjacent edges of the first and second radiating surfaces are at least partially elliptical.

4. The antenna of claim 3, wherein the elliptical portion of the first and second radiating surfaces have a ratio of a major axis to a minor axis in the range of approximately 1.00:1 to 1.90:1.

5. The antenna of claim 4, wherein the length of the minor axis is $\leqq 0.20\lambda$.

6. The antenna of claim 4, wherein at least one radiating surface has cutouts in the ellipse shape to allow for placement of through holes.

7. The antenna of claim 1, wherein at least a portion of the poise radiating surface is non-planar.

8. The antenna of claim 7, wherein the non-planar area is created by at least one bend in the poise radiating surface.

9. The antenna of claim 1, wherein the first plane is a top surface of a dielectric substrate and the second plane is a bottom surface of the dielectric substrate.

10. The antenna of claim 1, wherein the antenna is connected to a device chosen from the group consisting of a cell phone handset, a computer connected to a local area network, a PDA, a computer peripheral device, a collision-detection system, a suspension system, through-wall imaging systems and a ground-penetrating radar.

11. The antenna of claim 1, wherein the first radiating surface and the second radiating surface are configured and positioned so there is a gap between the first radiating surface and the second radiating surface, wherein the length of the end-feed microstrip extends beyond the gap between the first radiating surface and the second radiating surface.

12. A dipole antenna comprising:

a first plane;

a second plane spaced apart from the first plane;

a first radiating surface, positioned substantially on the first plane, to act as a poise;

a second radiating surface positioned on the first plane to act as a counterpoise;

at least two slots formed in the second radiating surface which effectively form a choke between the counterpoise and a ground plane; and an end-feed microstrip positioned on the second plane, wherein the first radiating surface and the second radiating surface are electromagnetically coupled to the end-feed microstrip to form said dipole antenna, and wherein the end-feed microstrip is configured to match an impendence of the first radiating surface and the second radiating surface based on both a length of the end-feed microstrip and a width of the end-feed microstrip such that a first end of the end-feed microstrip is wider than a second end.

13. The antenna of claim 12, wherein adjacent edges of the first and second radiating surfaces are at least partially elliptical.

14. The antenna of claim 12, wherein at least a portion of the poise radiating surface is non-planar.

15. The antenna of claim 14, wherein the non-planar area is created by at least one bend in the poise radiating surface.

16. The antenna of claim 12, wherein the first radiating surface and the second radiating surface are configured and positioned so there is a gap between the first radiating surface and the second radiating surface, wherein the length of the end-feed microstrip extends beyond the gap between the first radiating surface and the second radiating surface.

17. A dipole antenna comprising:

a first plane;

a second plane spaced apart from the first plane;

a first radiating surface, positioned on the first plane, to act as a poise;

a second radiating surface to act as a counterpoise;

at least two slots formed in the second radiating surface which effectively form a choke between the counterpoise and a ground plane;

an end-feed microstrip positioned on the second plane, wherein the end-feed microstrip is configured to match an impendence of the first radiating surface and the second radiating surface based on both a length of the end-feed microstrip and a width of the end-feed microstrip such that a first end of the end-feed microstrip is wider than a second end; and means for electromagnetically coupling the first radiating surface and the second radiating surface to the end-feed microstrip to form said dipole antenna.

18. The antenna of claim 17, wherein the first radiating surface and the second radiating surface are configured and positioned so there is a gap between the first radiating surface and the second radiating surface, wherein the length of the end-feed microstrip extends beyond the gap between the first radiating surface and the second radiating surface.

* * * * *